US011224985B2

(12) United States Patent
Kasner et al.

(10) Patent No.: US 11,224,985 B2
(45) Date of Patent: Jan. 18, 2022

(54) SLICER

(71) Applicant: Prince Castle LLC, Carol Stream, IL (US)

(72) Inventors: Rebecca Kasner, Shaumburg, IL (US); Caitlin Sweeney, Evanston, IL (US); Richard Bauer, Palatine, IL (US); Jeremy Falkos, Batavia, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 16/567,808

(22) Filed: Sep. 11, 2019

(65) Prior Publication Data

US 2020/0078972 A1 Mar. 12, 2020

Related U.S. Application Data

(60) Provisional application No. 62/729,699, filed on Sep. 11, 2018.

(51) Int. Cl.

| | |
|---|---|
| ***B26D 3/30*** | (2006.01) |
| ***B26D 5/10*** | (2006.01) |
| ***B26D 7/06*** | (2006.01) |
| ***B26D 1/03*** | (2006.01) |

(52) U.S. Cl.

CPC ..... *B26D 3/30* (2013.01); *B26D 1/03* (2013.01); *B26D 5/10* (2013.01); *B26D 7/0608* (2013.01); *B26D 2210/06* (2013.01)

(58) Field of Classification Search

CPC ... B26D 3/30; B26D 5/08; B26D 5/10; B26D 7/0608; Y10T 83/695; Y10T 83/75

See application file for complete search history.

(56) References Cited

U.S. PATENT DOCUMENTS

| | | | | | |
|---|---|---|---|---|---|
| 2,103,537 | A | * | 12/1937 | Killman | B26D 3/283 83/123 |
| 2,685,901 | A | * | 8/1954 | Putzer | B26D 3/30 83/870 |
| 2,789,606 | A | * | 4/1957 | Solomon | B26D 7/30 83/411.5 |
| 3,245,447 | A | * | 4/1966 | Jones | B26D 1/11 83/167 |
| 3,331,416 | A | * | 7/1967 | Waller | B26D 3/30 83/879 |
| 3,347,296 | A | | 10/1967 | Rothman | |

(Continued)

FOREIGN PATENT DOCUMENTS

| | | | |
|---|---|---|---|
| DE | 102011012474 | A1 | 10/2011 |
| DE | 202014006314 | U1 | 10/2014 |
| EP | 1621301 | A1 | 10/2010 |

*Primary Examiner* — Richard D Crosby, Jr.

(74) *Attorney, Agent, or Firm* — Andrus Intellectual Property Law, LLP

(57) ABSTRACT

A bagel slicer includes a frame. A pusher assembly translates along a slicing path within the frame between an open position and a sliced position. At least one blade is positioned within the slicing path. Movement of the pusher assembly along the slicing path from the open position to the sliced position translates a bagel along the slicing path about the at least one blade to slice the bagel. Movement of the pusher assembly along the slicing path from the sliced position to the open position returns the sliced bagel to the open position of the pusher assembly.

19 Claims, 8 Drawing Sheets

(56) References Cited

U.S. PATENT DOCUMENTS 3,853,027 A * 12/1974 Karlstrom ..... A41D 19/02 83/870
4,144,784 A * 3/1979 Jones ..... B26D 7/22 83/425.3
4,184,397 A * 1/1980 Jones ..... B26D 1/03 83/425.3
4,399,989 A 8/1983 Baillie
4,436,011 A * 3/1984 Jones ..... B26D 1/03 83/425.3
4,546,686 A * 10/1985 Losiowski ..... B26D 1/02 83/431
4,567,801 A * 2/1986 Jones ..... B26D 1/03 83/404.3
4,662,257 A * 5/1987 Petersen ..... B26D 1/553 83/407
4,677,888 A * 7/1987 Terragnoli ..... A21C 15/04 225/94
4,747,331 A * 5/1988 Policella ..... B26B 29/063 83/762
4,807,505 A 2/1989 Campbell et al.
4,856,398 A * 8/1989 Kruse ..... B26D 7/0608 83/425.2
5,361,666 A * 11/1994 Kensrue ..... A21C 15/04 269/87.2
5,431,078 A * 7/1995 Ricard ..... B26B 29/063 83/454
5,690,013 A * 11/1997 Kanarek ..... A21C 15/04 83/762
5,732,610 A * 3/1998 Halladay ..... B26B 29/063 83/435.15
5,881,621 A * 3/1999 Dennis ..... B26B 29/063 83/167
6,145,427 A * 11/2000 Smith ..... B26D 3/30 83/167
6,244,153 B1 * 6/2001 McInnes ..... B26D 3/30 83/647
6,543,322 B2 4/2003 Skoko
6,647,850 B2 * 11/2003 Verklan ..... B26D 3/30 83/422
7,007,583 B1 3/2006 Fiola
9,694,506 B2 7/2017 Whitney
10,532,480 B2 * 1/2020 Fastabend ..... B26D 7/225
2001/0029823 A1 * 10/2001 Ancona ..... A47J 37/0871 83/537
2004/0211306 A1 * 10/2004 Woods ..... B26D 3/30 83/454
2016/0183728 A1 * 6/2016 Vardakostas et al. ..... A21C 15/002 426/466
2018/0229395 A1 * 8/2018 Zhu ..... B26D 1/02

* cited by examiner

SLICER

CROSS-REFERENCE TO RELATED APPLICATION

The present application claims priority of U.S. Provisional Patent Application No. 62/729,699, filed on Sep. 11, 2018, the contents of which are hereby incorporated by reference in its entirety.

BACKGROUND

Restaurants and food service providers often slice bread or other food products for customers or they use sliced bread or other food products as part of their menu items. Slicing bread and bread products like bagels require a sharp knife edge to be drawn across the bread product/bagel at the same that the knife edge is pushed or urged into the bread product being cut. Still other food, including but not limited to vegetables and fruits may also need to be sliced in a restaurant and/or food services setting. Solutions are desirable for slicing bread and/or other food products.

The slicing effect depends in part on the speed or rate at which a knife-edge is drawn across a bread product relative to a rate at which a knife-edge is urged into the bread product. The slicing effect also depends on the sharpness of a blade and the thickness of a blade.

Slicing a bagel laterally without crushing it or distorting its shape requires a thin blade to be drawn across the bagel at the same time that the blade is urged into the bagel. While prior art bread or produce slicers exist, such slicers frequently take up a large amount of space in order to accommodate a blade set, an actionable arm, and the travel path of the actionable arm. Slicers typically take one of two forms. The actionable arm may be secured to a pusher and the food item is pushed through a stationary blade set. Alternatively, the actionable arm is secured to the blade set and the blade set is pushed through a stationary food item. Additional solutions for slicing of bread products in a compact device footprint are therefore desirable.

BRIEF DISCLOSURE

An example of a bagel slicer includes a frame. A pusher assembly is translatable along a slicing path within the frame between an open position and a sliced position. At least one blade is positioned within the slicing path. Movement of the pusher assembly along the slicing path from the open position to the sliced position translates a bagel along the slicing path about the at least one blade to slice the bagel. Movement of the pusher assembly along the slicing path from the sliced position to the open position returns the sliced bagel to the open position of the pusher assembly.

The bagel slicer may further include a crown caddy having a body and an aperture through the body. The crown caddy is connected to the pusher assembly. A sled is connected to the pusher assembly. The sled is aligned with and spaced apart from the crown caddy. The sled may include a depression formed into the body of the sled. The depression may be in alignment with the aperture of the crown caddy. The crown caddy may be spaced apart from the sled by a distance to receive the at least one blade therebetween. A cover secured across the frame may enclose at least a portion of the bagel slicer. The cover may enclose an area about the crown caddy and the sled when the pusher assembly is in the sliced position. The produce pusher may further include a pusher structure, an inside cover, and a heel cover. The pusher structure may include a handle at one end and an end plate at an end opposite the handle. The inside cover may be secured to the pusher structure and extend over the end plate. The crown caddy may engage the end plate and the inside cover. The heel cover may be secured to the pusher structure and may include a tie that extends past the at least one blade. The heel cover may include a planar portion that extends from the tie at a position that translates with the pusher assembly along a side of the at least one blade opposite from the pusher structure. The sled may engage the heel cover. The at least one blade may be a pair of blades angled towards a centerline of the frame and away from the pusher assembly in the open position. The pair of blades may include blade arms secured to the frame. The blade arms may be secured exterior of the frame and the blades extend through slots in the frame to the interior of the frame.

An example of a bagel slicer includes a frame having first and second sides extending from a base. A pusher assembly is translatable along a slicing path within the frame between an open position and a sliced position. A pair of blades are secured to the frame and angled towards a centerline of the frame and away from the pusher assembly in the open position. A sled is connected to the pusher assembly. A crown caddy having a body and an aperture through the body is connected to the pusher assembly. The crown caddy is spaced apart from the sled by a distance configured to receive the pair of blades therebetween as the pusher assembly translates along the slicing path between the open position and the closed position.

The bagel slicer may further include a pair of rails that extend internal the frame and the pusher assembly is movably secured to and translates along the pair of rails. The pusher assembly may include a pusher structure including a handle at one end and a depending plate, a planar plate, and an end plate arranged at an end opposite the handle. Aligned apertures may extend through the end plate and the depending plate of the pusher structure. A coaxial spacer may extend between the aligned apertures and a rail extends internally to the frame and through the aligned apertures and the coaxial spacer. A heel cover may be secured at a heel cover body to the pusher structure. The heel cover narrowing from the heel cover body to a tie. The tie connected to a planar portion of the heel cover that translates along a side of the pair of blades opposite the heel cover body. The sled may be connected to the pusher assembly at the heel cover. An inside cover may be secured at an inside cover body to the pusher structure. The inside cover extending over the depending plate, the planar plate, and the end plate. The inside cover may include a cover flange that extends along the end plate of the pusher structure. The crown caddy may be connected to the pusher structure by engagement between the crown caddy and the cover flange and the end plate.

A method of slicing a bagel may include moving the pusher assembly to the open position. An unsliced bagel is loaded through the aperture of the crown caddy to rest on the sled. The pusher assembly is moved along the slicing path to the sliced position to move the crown caddy and the sled past the pair of blades on opposite sides of the pair of blades. The bagel is sliced into a crown portion and a heel portion as the pair of blades moves between the crown caddy and the sled. The method may further include moving the pusher assembly from the sliced position to the open position along the slicing path. The crown portion of the bagel and the crown caddy may be moved along a first side of the pair of blades. The heel portion of the bagel and the sled may be moved along a second side of the pair of blades. The sliced crown portion and heel portion of the bagel may be provided on the sled with the pusher assembly in the open position.

DETAILED DESCRIPTION

A bagel will be used herein as a non-limiting example of a baked good to be sliced. A bagel is a firm doughnut-shaped roll, traditionally made by boiling and then baking. Often, bagels have an outside diameter between about three and six inches. Additionally, bagels often have a nominal thickness between about one inch up to about two and one-half inches. Therefore, in some examples, a ratio of a bagel's nominal thickness to its nominal outside diameter may range between about 0.16 up to about 0.833.

Figure 1:
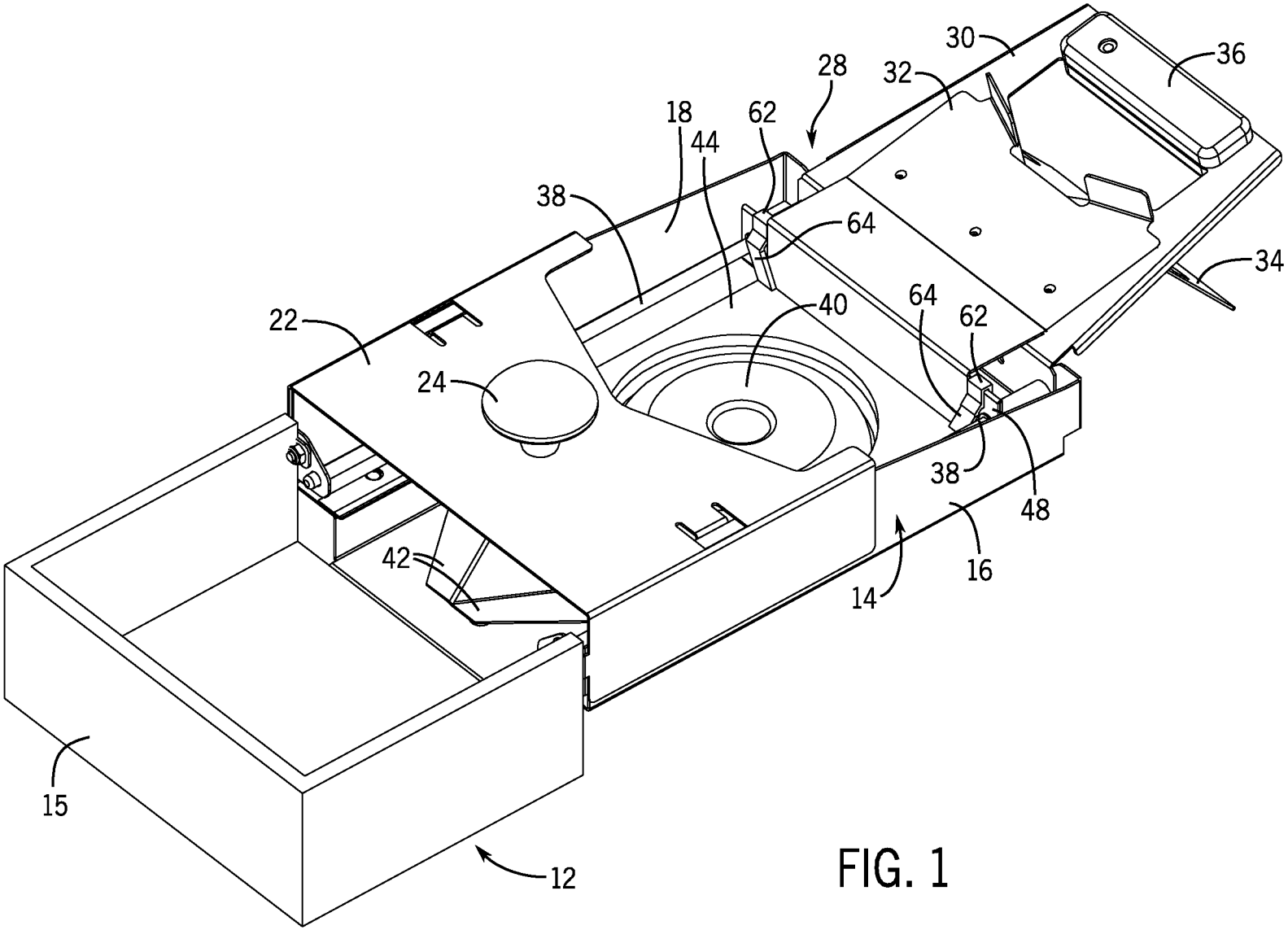
FIG. 1 is a perspective view of a bagel slicer in an open position viewed from a back end of a frame.
Figure 2:
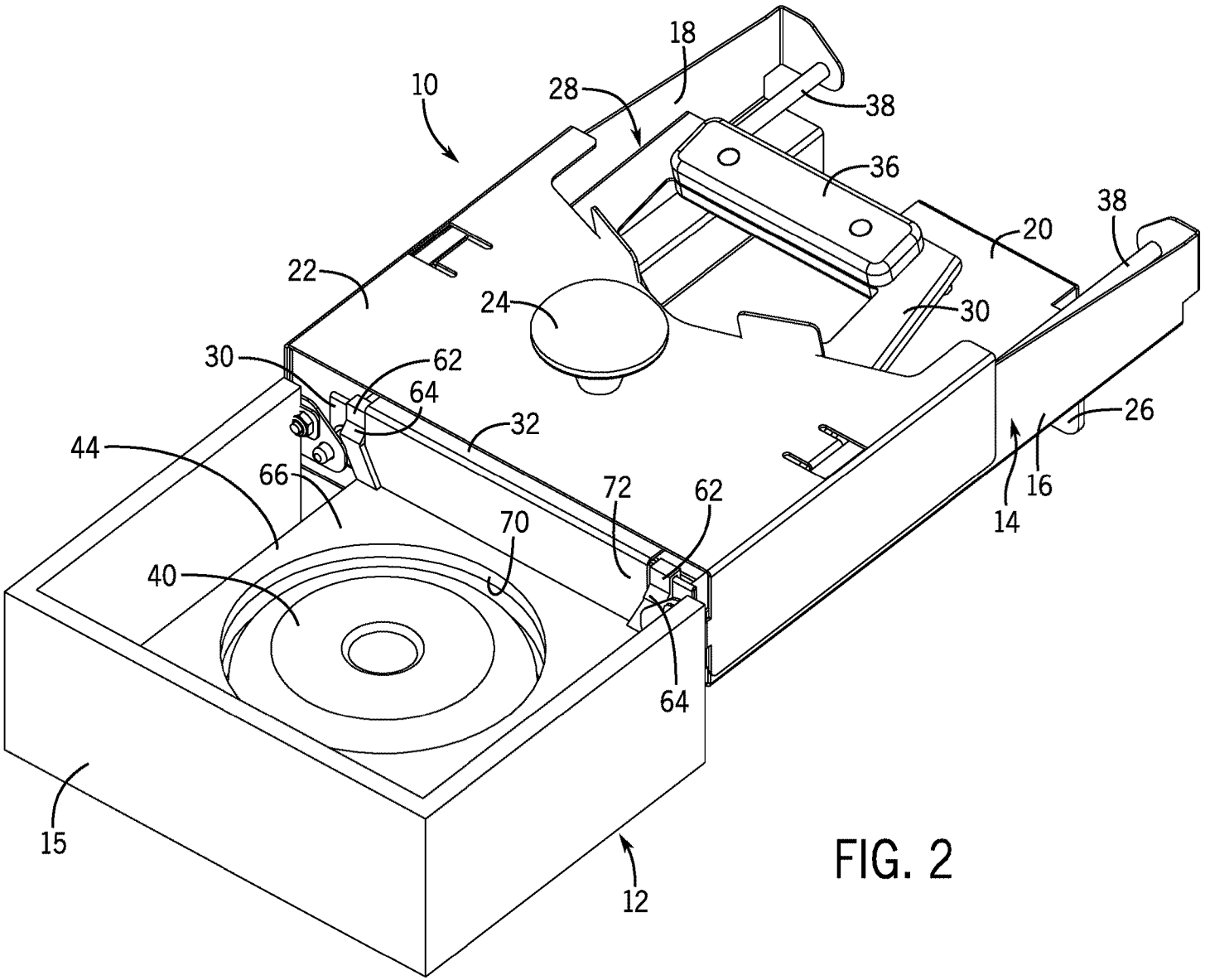
FIG. 2 is a perspective view of the bagel slicer in the sliced position viewed from the back end of the frame.
Figure 3:
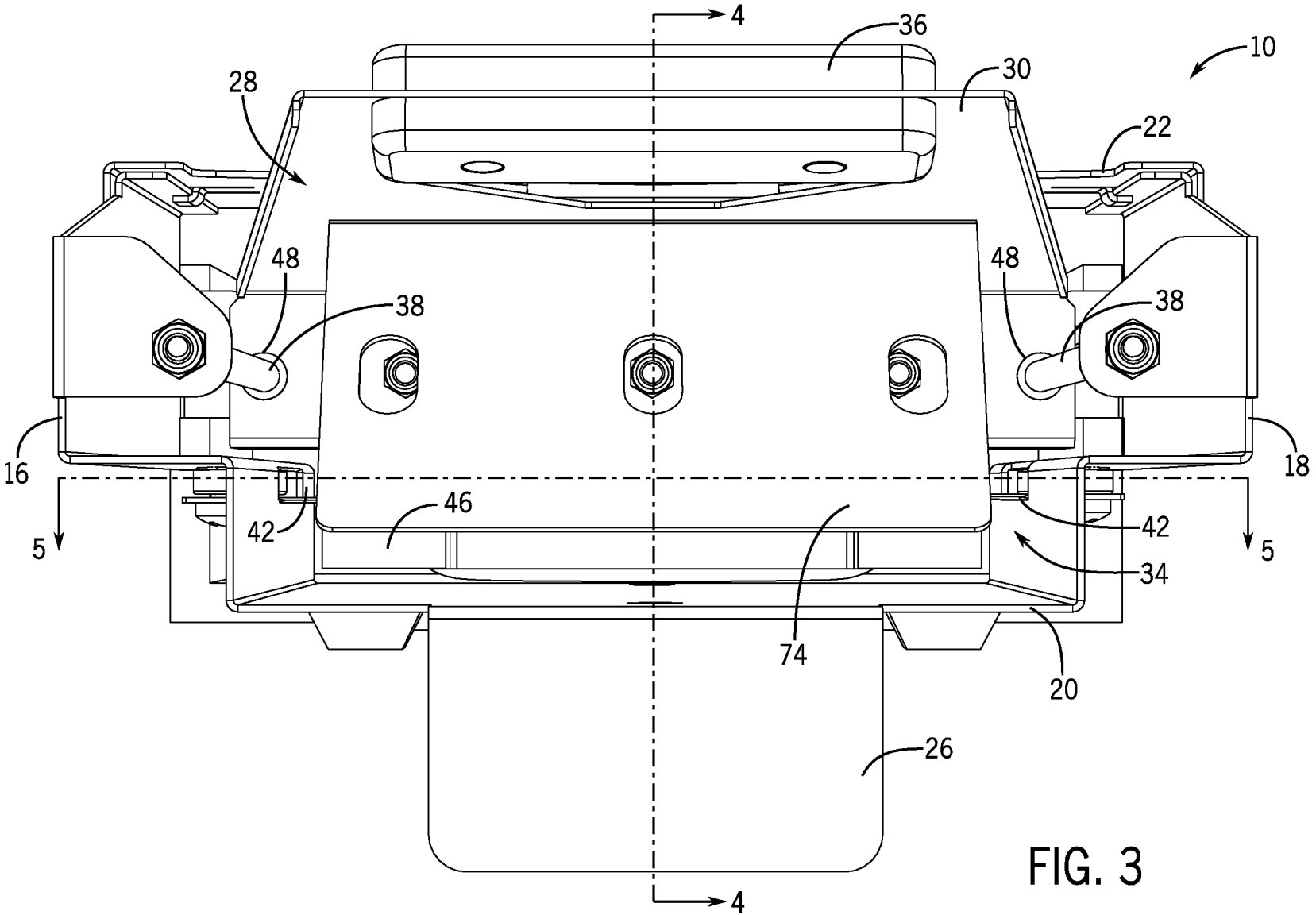
FIG. 3 is a front view of the bagel slicer in the sliced position.

FIG. 1 is a perspective view of a bagel slicer 10 viewed from a back end 12. The bagel slicer 10 is depicted in the open position in which a bagel can be loaded and unloaded from the slicer 10. FIG. 2 is a perspective view of the bagel slicer 10 viewed from the back end 12 in a sliced position in which, as described herein, the bagel has been fully sliced but has not been returned to the open position. FIG. 3 is a front view of the slicer 10 in the sliced position. The bagel slicer 10 includes a frame 14 is comprised of first and second sides 16, 18 that extend generally perpendicularly from a base 20. The sides 16, 18 may optionally include a shelf 16A, 18A which reduces some of the volume within the interior of the frame 14, does not change the overall relationship between the sides 16, 18 and the base 20. A compartment 15 is positioned at the back end 12 of the slicer 10. While the compartment 15 is depicted as a separate component secured to the frame 14. It will be recognized that the frame 14 and the compartment may be unitarily constructed or otherwise constructed of components secured to one another. A cover 22 is configured to secure to the frame 14 to at least partially enclose the slicer 10. While the cover 22 is depicted as not enclosing the compartment 15, this is for clarity purposes, for example showing the inside of the compartment 15 and the compartment 15 may be enclosed, and further may be enclosed by the cover 22 extending over the compartment 15.

The cover 22 may include a knob 24 extending from the cover 22. Particularly in embodiments wherein the slicer is not fixed to a supporting structure like a counter or shelf, the user may use two hands to operate the slicer by placing a holding force on the knob 24 while operating the slicer 10 with their other hand as explained herein. The slicer 10 may be mounted on top of a counter, and for example, held in place by lip 26 which extends from the base 20 to engage over an edge of the counter. In another embodiment, the cover 22 is configured to secure below a countertop, for example on a shelf, within a cabinet, or mounted to an underside of the countertop. The lip 26 may further exemplarily engage another structural component within the kitchen to facilitate securement of the slicer 10 to a location within the kitchen.

Figure 4:
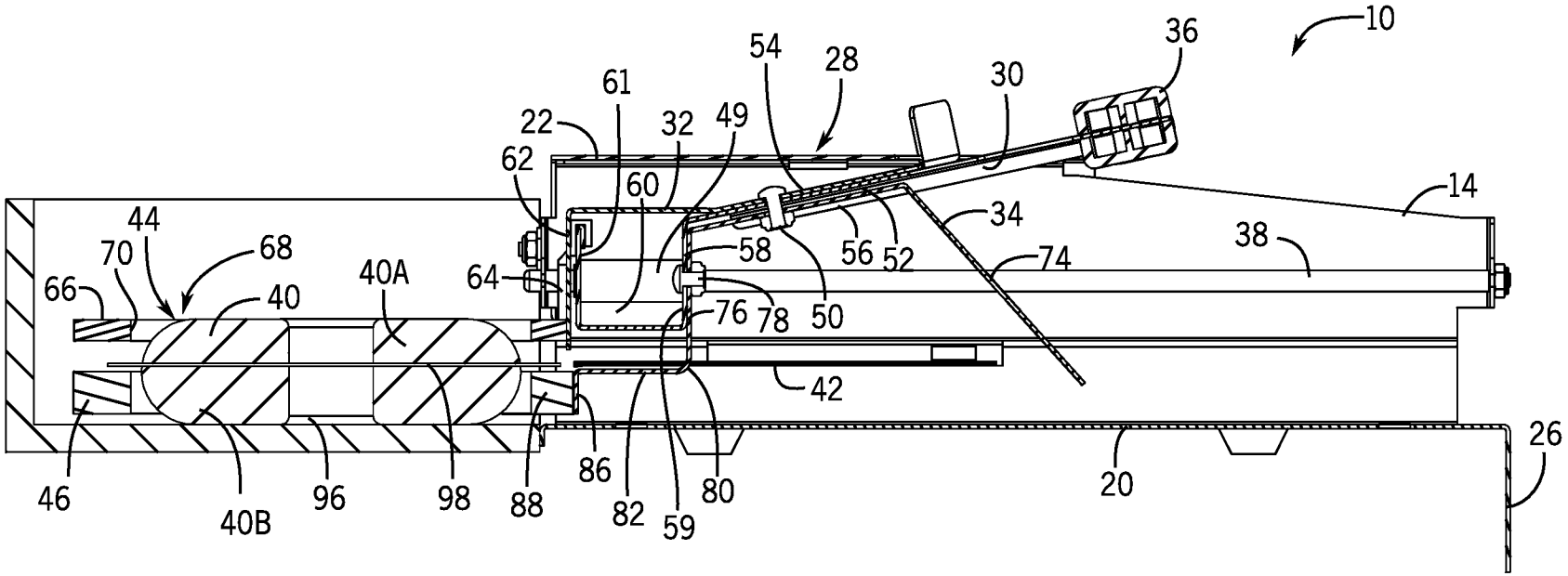
FIG. 4 is a cross-sectional view of the bagel slicer as taken along line 4-4 of FIG. 3.

The bagel slicer 10 includes a pusher assembly 28. The pusher assembly 28 moves relative to the frame 14 between the open and sliced positions of the slicer 10. The pusher assembly 28 operates to receive a bagel 40 to move the bagel through the blades 42 positioned within the slicer. The pusher assembly 28 includes a pusher structure 30, an interior cover 32, and a heel cover 34. The heel cover 34 is best depicted in FIG. 4 which is a cross-sectional view taken along line 4-4 of FIG. 3. The pusher structure 30 includes a handle 36 configured to be gripped by the user.

Figure 5:
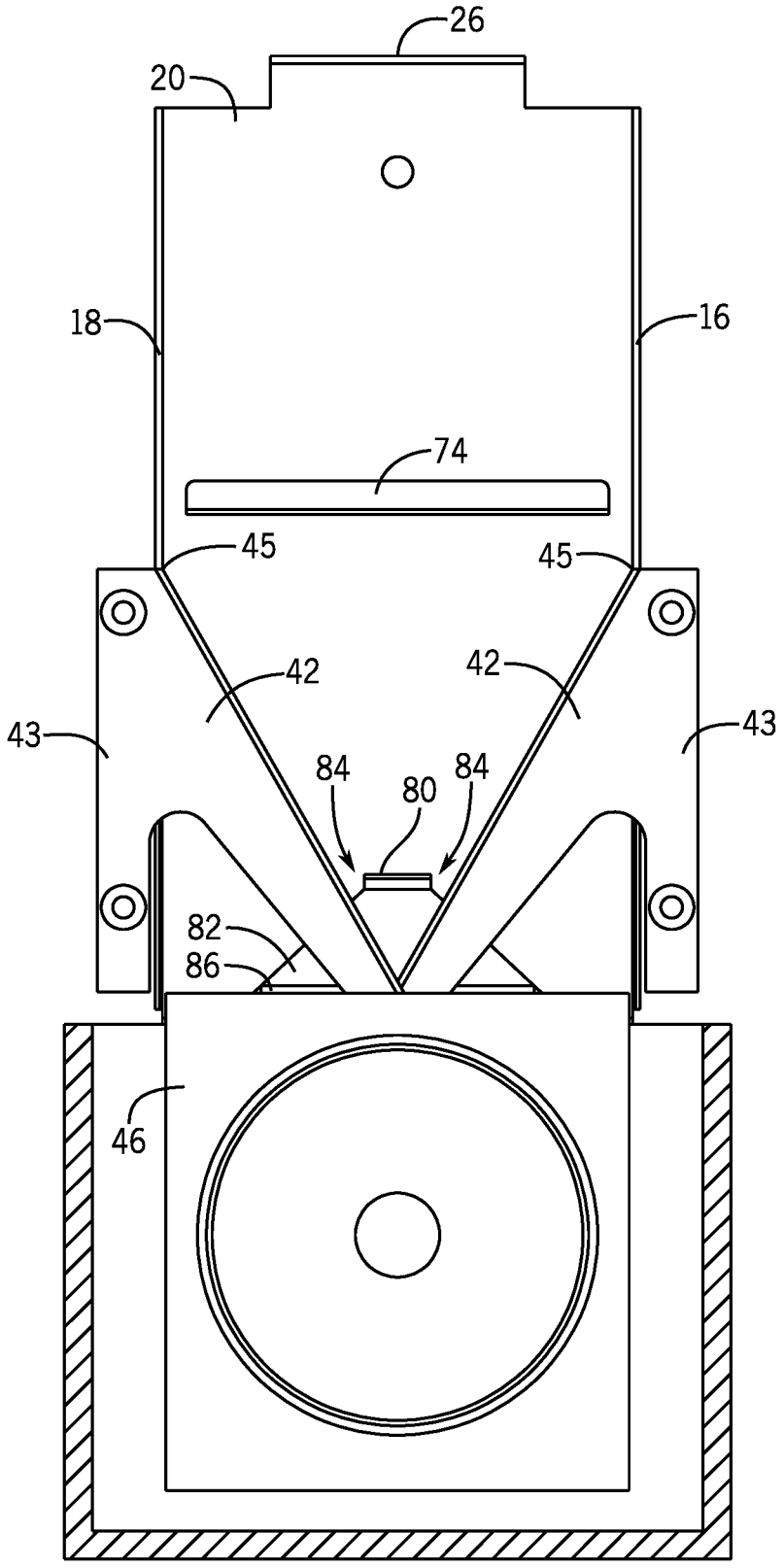
FIG. 5 is a cross-sectional view of the bagel slicer as taken along line 5-5 of FIG. 3.
Figure 6:
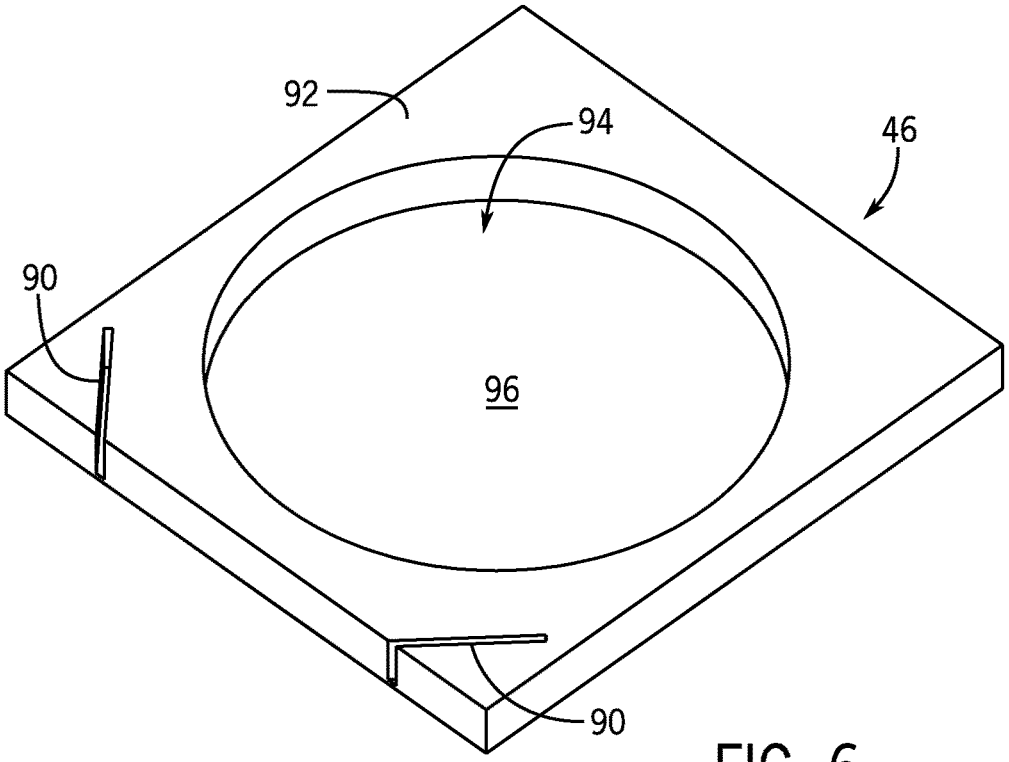
FIG. 6 depicts an example of a sled.

The pusher assembly 28 engages rails 38. Specifically, the pusher structure 30 includes apertures 48. The rails 38 extend through the apertures 48 and the pusher assembly is translatable within the frame 14 along the rails 38. The pusher assembly 28 moves a bagel 40 received therein through a pair of blades 42 which are affixed to the frame 14 at inwardly angled orientations. The blades 42 are best depicted in FIG. 5 which is a cross-sectional view taken along line 5-5 of FIG. 3. As shown in FIG. 5, the blades 42 are inwardly angled so as to meet at a centerline of the frame 14. It will be recognized that the blades 42 may be implemented as two separate blades connected at their apex or intersection or may be a single blade that includes two portions angled in opposite directions. As will be described in further detail herein, a crown caddy 44 and a sled 46 are connected to the pusher assembly 28 and hold the bagel 40 in a position both before and after it is sliced by the blades 42.

Exemplary embodiments of the bagel slicer 10 as described herein facilitate the slicing of a bagel in a manner such that the bagel is loaded into the slicer 10 and the sliced bagel removed from the slicer 10 at the same position. This promotes efficiencies in operation and safety as there is one area of interaction between the user and the slicer. Embodiments provide adaptability for use in a variety of locations and orientations in a manner that promotes flexibility of workspace configuration. Embodiments may achieve these effects, at least in part, through the use of a crown caddy 44 and the sled 46 as will be described in further detail herein.

In the cross-sectional view of FIG. 4, the exemplary arrangement and configuration of the pusher assembly 28 is more clearly depicted. The pusher assembly 28 exemplarily includes the pusher structure 30, the interior cover 32, and the heel cover 34. While these components are depicted as separate, it will be recognized that in other embodiments, these components may be integral or may take another arrangement as will be recognized from the disclosure herein. The pusher structure 30 is positioned between the interior cover 32 and the heel cover 34. Exemplarily, the pusher structure 30, interior cover 32, and heel cover 34 are secured by one or more fasteners 50, for example, bolts and nuts, although other forms of fasteners including, but not limited to rivets and welds, will be recognized by a person of ordinary skill in the art. The pusher structure 30 includes a handle portion 52, to which the handle 36 is secured at one end. The handle portion 52 is also in engagement with interior cover body 54 and heel engagement cover body 56 by the aforementioned fasteners 50.

The pusher structure 30 includes a front portion 58 which is exemplarily U-shaped, although it will be recognized that other shapes or configurations of the front portion 58 may be used, including the rectangular U-shape as depicted in FIG. 4. The U-shaped front portion 58 exemplarily includes a depending plate 59, a planar plate 60, and an end plate 61. The planar plate 60 extends parallel to the base 20 and the blades 42. Apertures 48 are exemplarily located in both the depending plate 59 and the end plate 61 and the rails 38 extend through both plates. A coaxial spacer 49 extends between the depending plate 59 and the end plate 61. The rails 38 also extend through the coaxial spacer 49.

The interior cover 32 is connected to the pusher structure 30 by engagement between the interior cover body 54 with the handle portion 52 as previously described. The interior cover 32 extends over and past the depending plate 59, planar plate 60, and the end plate 61 of the front portion 58. A cover flange 72 of the interior cover 32 extends along the exterior surface of the end plate 61.

Figure 7:
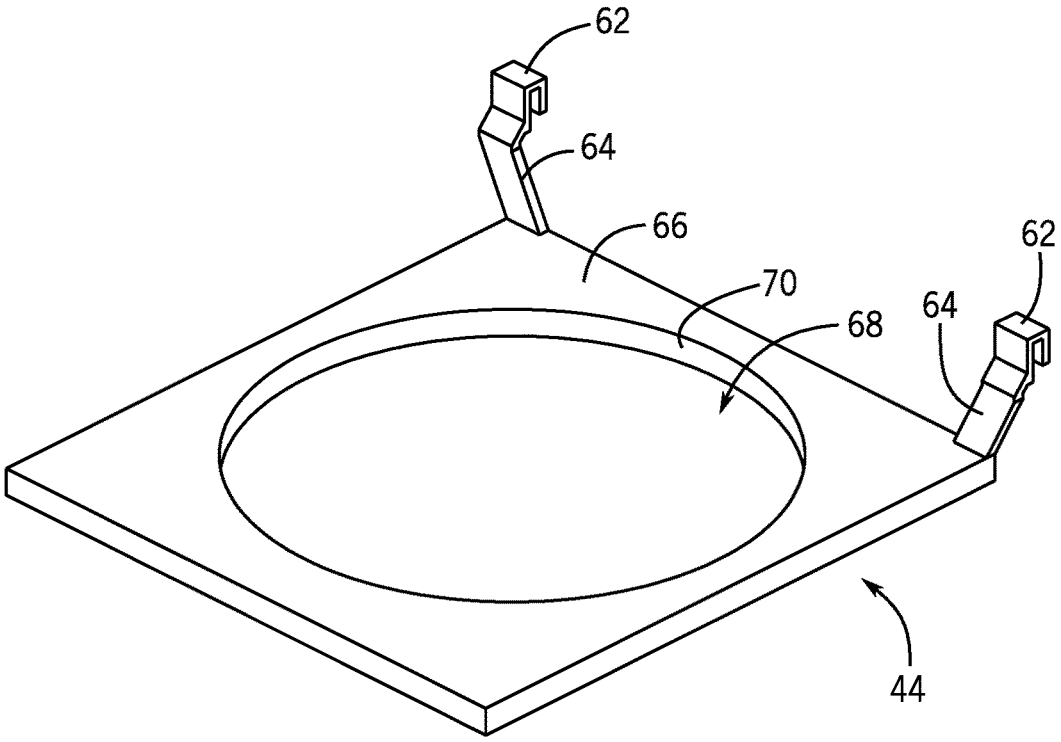
FIG. 7 depicts an example of a crown caddy.

The crown caddy 44, which is individually depicted in FIG. 7, exemplarily engages the pusher assembly 28 at multiple points. Hooks 62 of the crown caddy 44 connect the crown caddy 44, to the end plate 61 of the pusher structure 30. The hooks 62 are at the ends of arms 64 which extend from a body 66 of the crown caddy 44. The body 66 of the crown caddy 44 is positioned against the cover flange 72. The arms 64 extend in front of the cover flange 72 and laterally beyond the cover flange 72 and to the end plate 61 behind the cover flange 72. Engagement between the arms 64 and hooks 62 with the end plate 61 and the flange 72 helps to secure the crown caddy 44 in position relative to the pusher assembly 28. An aperture 68 is formed through the body 66 and is configured to receive the crown of the bagel. As will be described in further detail herein, the interior surface 70 of the aperture 68 through the body 66 engages the crown of the bagel and transfers the translational force from the pusher assembly 28 to the bagel crown.

The heel cover 34 is connected to pusher structure 30 by engagement between the heel cover body 56 and the handle portion 52 in the manner described above. The heel cover 34 is arranged on a side of the pusher structure 30 opposite from the interior cover 32. An example of the heel cover 34 is shown in isolation in FIG. 8 from other structures of the bagel slicer 10. The heel cover 34 includes a blade guard 74 which extends away from the handle portion 52 of the pusher structure 30. The blade guard 74 serves to block access to the blades 42 of the bagel slicer 10, particularly when the pusher assembly 28 is moved to the sliced position (FIG. 2) and the handle 36 is in a position proximate to the blades 42. A depending portion 76 extends from the other end of the heel cover body 56 and exemplarily engages the depending plate 59. One or more fasteners 78 may secure the depending portion 76 to the depending plate 59. The depending portion 76 extends beyond the planar plate 60 of the pusher structure 30 and further extends beyond the blades 42 of the slicer 10. In an exemplary embodiment, the depending portion 76 narrows to a tie 80 which connects the depending portion 76 to a planar portion 82 positioned below both the planar plate 60 and the blades 42. With movement of the pusher assembly 28, the planar portion 82 translates in a plane on a side of the blades 42 opposite from the planar plate 60.

FIG. 5 is a cross-sectional view of the slicer 10 as taken along line 5-5 of FIG. 3 and provides a view of the blades 42 and the planar portion 82. The blades 42 include blade arms 43 that are respectively mounted to the undersides of the shelves 16A, 18A. The blades 42 extend interior of the frame 14 through slots 45 in the sides 16, 18. The blades 42 angle inwardly from the sides 16, 18. As seen by reference to FIGS. 4, 5, and 8, the narrowing of the depending portion 76 and the planar portion 82 to the tie 80 creates cutouts 84 through which the blades 42 extend as the pusher assembly 28 is moved to the sliced position. The heel cover 34 thus accommodates the pusher assembly 28 to move the bagel entirely through the angled blades 42 to slice the bagel.

A heel wall 86 extends from the planar portion 82. The heel wall 86 engages the sled 46. Additionally, opposed tabs 88 extend from the heel wall 86. The opposed tabs 88 exemplarily extend at angles from the heel wall 86. The angled opposed tabs 88 provide an engagement surface to connect the heel cover 34, and by extension, the rest of the pusher assembly 28 to the sled 46.

Figure 8:
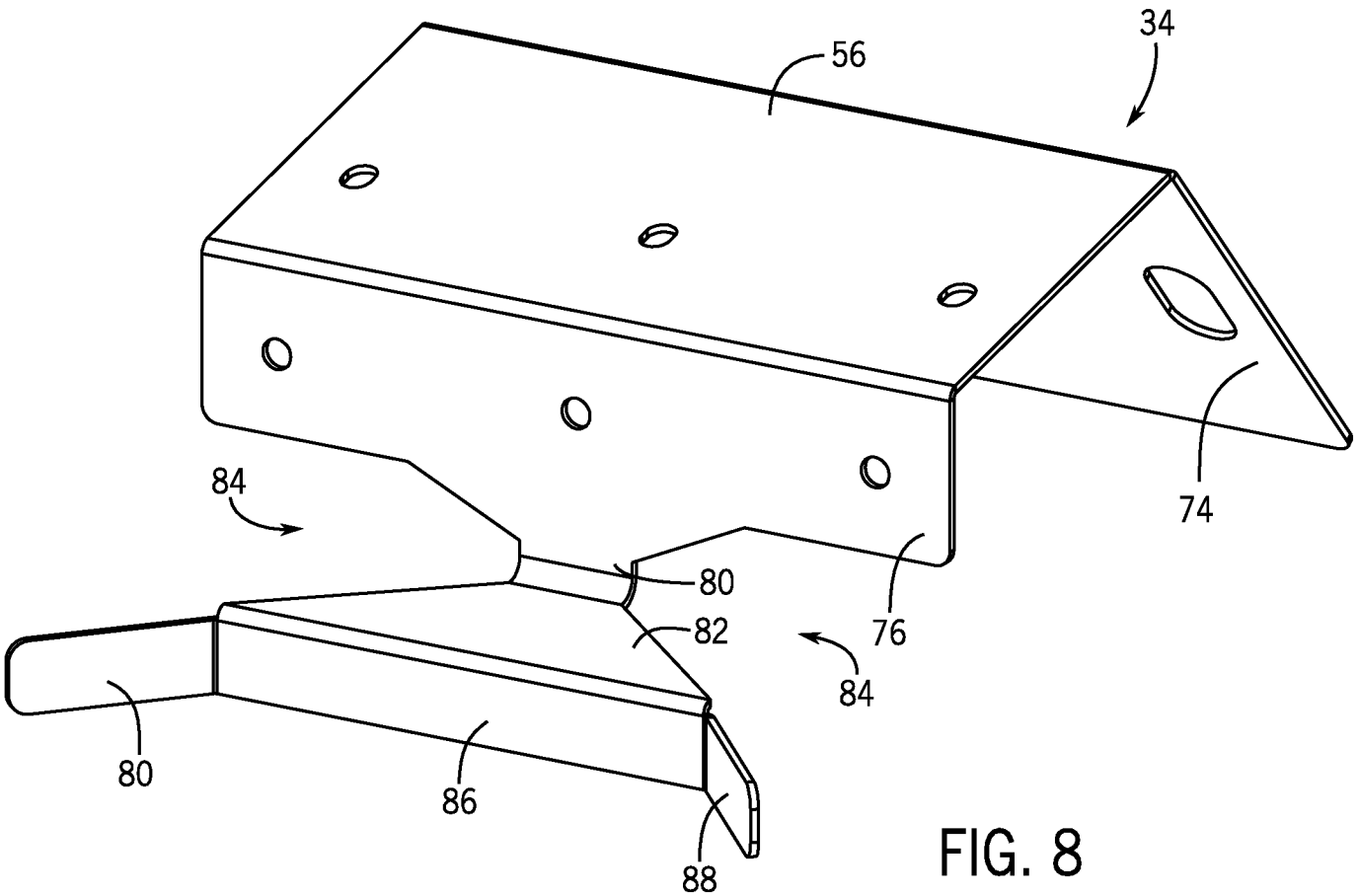
FIG. 8 depicts an example of a heel cover.

FIG. 8 depicts an exemplary embodiment of a sled 46. The sled 46 is configured to receive the bagel and to translate the heel portion of the bagel. The sled 46 is connected to the pusher assembly 28 and the heel cover 34 by engagement of the tabs 88 within receiving slots 90 formed into a body 92 of the sled 46. The sled 46 includes a depression 94 formed into the body 92 of the sled 46. The depression 94 includes a floor 96 upon which the heel of the bagel rests. In this manner, the bagel is supported and translated within the sled 46 prior to and during cutting of the bagel with the blade 42. After the bagel 40 is cut, the heel of the bagel is supported and moved by the sled 46. The floor 96 upon which the bagel (bagel heel) rests to reduce sliding friction of the bagel itself which improves cutting. Because the bagel remains stationary relative to the floor 96, frictional forces on the bagel are reduced which improves slicing by the blades 42. Friction between the sled 46 and the base 20 exists but does not have an impact on the slicing by the blades 42 through the bagel 40.

During use, the pusher assembly 28 is drawn outward by the handle 36. This pulls the pusher assembly 28, the sled 46, and the crown caddy 44 outward relative to the frame 14 to an open position as depicted in FIG. 1. The crown caddy 44 and the sled 46 are secured to the pusher assembly as described above. The aperture 68 of the crown caddy 44 is in alignment with the depression 94 of the sled 46. A bagel 40 a bagel can be placed through the aperture 68 to rest upon the floor 96 of the sled 46. While the bagel 40 is whole at this point in the operation, the crown of the bagel 40 is at least partially surrounded by the crown caddy 44 and the heel of the bagel is at least partially surrounded by the body 92 of the sled 46.

The user pushes the handle 36 to move the pusher assembly 28, the crown caddy 44, and the sled 46 inward into the frame 14. The bagel 40 is moved by the sled 46 upon which it sits. As the pusher assembly 28 and the bagel 40 are translated interior the frame 14, the crown caddy 44 translates along one side of the blades 42, while the sled 46 translates to the other side of the blades 42. The bagel 40 comes into contact with the blades 42 which places resistance against the bagel 40. At this point, force is translated from the pusher assembly into the bagel 40 through the respective bodies of the crown caddy 44 and the sled 46. This places translating forces on both the eventual crown portion of the bagel and the eventual heel portion of the bagel. As the blades 42 slice into the bagel 40 and the crown and heel become more detached and distinct, the separate forces from the crown caddy 44 and the sled 46 serve to independently translate the crown and heel portions. When the bagel 40 has been moved entirely through the blades 42, the pusher assembly has been moved into the sliced position as depicted in FIG. 2.

To withdraw the sliced bagel, returning the sliced bagel to the same location at which the bagel was loaded into the slicer, the user pulls on the handle 36 drawing the pusher assembly 28 out of the frame 14. The bodies of the crown caddy 44 and the sled 46 respectively transfer this translating force from the pusher assembly 28 to the crown and the heel of the bagel 40 and draw the crown and heel past the blades 42 to return the pusher assembly 28 and the sliced bagel to the original loading location. After the bagel 40 has been drawn back across the blades 42, the crown portion may be in contact with the heel portion and translation of the sled 46 translates both the crown and heel portions of the bagel.

FIG. 4 depicts a further optional component which may be used in examples of the slicer 10. An intermediate support 98 is positioned co-planar to the blades 42 in a manner such that the intermediate support 98 receives the crown 40A after the bagel 40 has been sliced and retains the crown 40A at a position relative to the blades 42. When the pusher assembly 28 is withdrawn to draw the bagel crown 40A and bagel heel 40B back past the blades 42 to the open or loading position for removal of the now sliced bagel, the intermediate support keeps the crown 40A at a position to slide over the blades 42. In examples without an intermediate support 98, the crown 40A may rest upon the heel 40B when the pusher assembly is in the sliced position, and upon return, of the pusher assembly, the crown 40A may become stuck or damaged by the blades 42. The intermediate support 98, prevents this inadvertent contact between the blades 42 and the edge of the crown 40A and promotes sliding of the crown 40A over the blades 42. The crown caddy 44 and the sled 46 are dimensioned such as to be movable with the intermediate support 98 positioned therebetween. In an example, the intermediate support 98 may extend between sides of the frame 14 or between other supportive components of the compartment 15. The support 98 exemplarily extends rearward from the blades 42 and in the same plane as the blades 42. The crown of the bagel rests upon the support 98. When the user draws the pusher assembly 28 back to the open/loading most position, the sliced bagel is pulled back over the blades. The support 98 reduces friction between the bagel halves and keeps the crown in alignment with the blades 42, for improved withdrawal.

Figure 9:
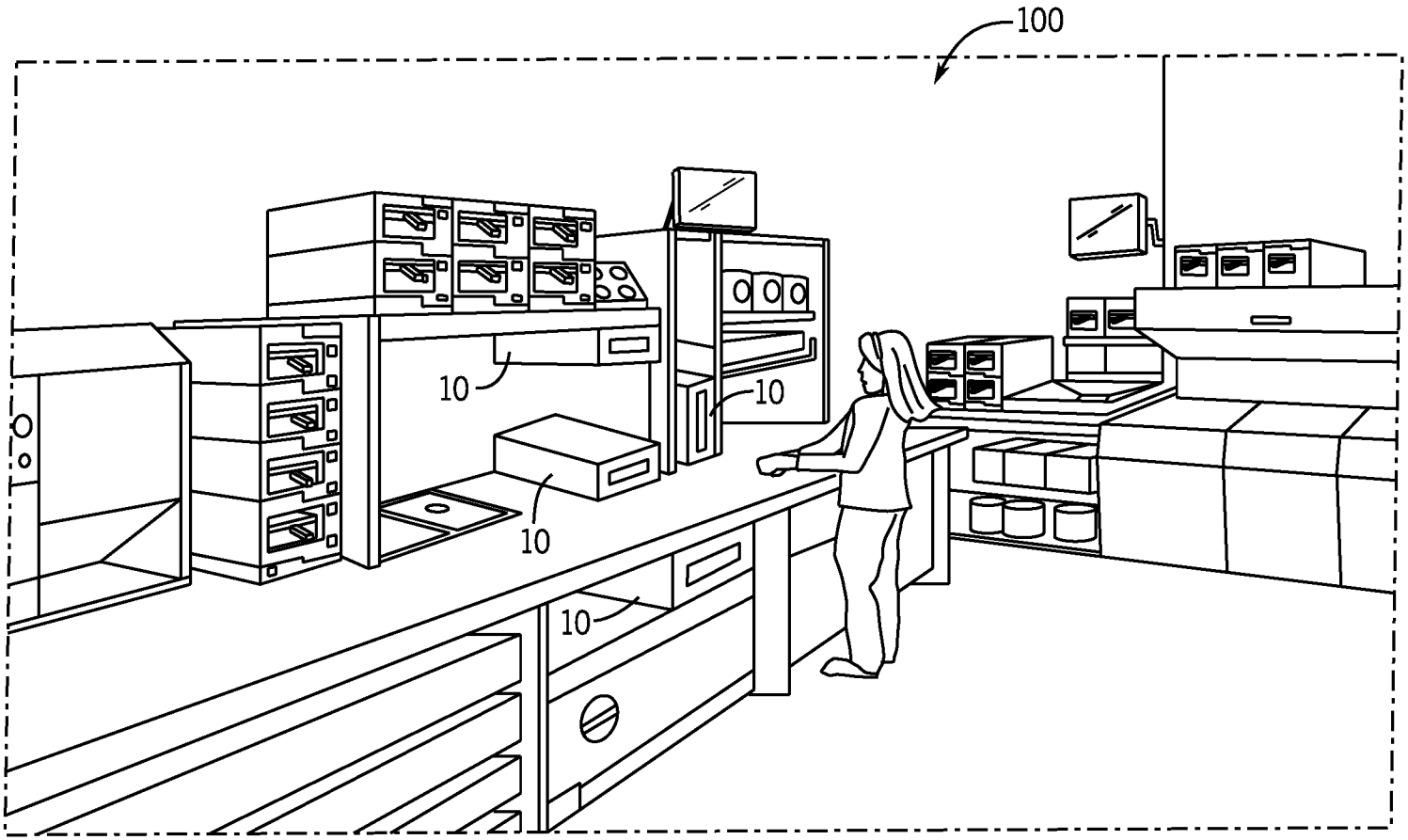
FIG. 9 depicts an environmental view of a kitchen in which a variety of orientations of bagel slicers are shown.

FIG. 9 presents an environmental view of a kitchen 100 in which a variety of orientation of bagel slicers 10 are depicted. Thus, an exemplary embodiment of the bagel slicers 10 as described herein can be accommodated in a variety of spaces and/or orientations, including under counter, under shelf, on top of counter, and in both horizontal and vertical orientations. Thus, embodiments of the bagel slicer disclosed herein enable flexible and adaptable configuration and use within a kitchen environment.

Still additional features may be incorporated into slicers as disclosed herein and are considered to be within the scope of the present disclosure. For example, while flat blades are depicted, serrated blades may be used. In an example, a serrated blade facilitates cutting of food by first piercing the skin or outer surface of the food with one or more points of the serrated blade which reduces an initial surface are sliced by the blades and can reduce crushing or deformation of the food product when pushed against the blades. Additionally, the point of a serrated blade, when used in conjunction with an angled blade relative to a direction of movement of the food in the cradle, facilitates to hold the food in a position relative to the blade which counteracts a tendency of the food product to bunch in a direction down the angle of the blade. In an exemplary embodiment serrated blades further provide additional cutting surface, facilitating slicing of the food.

In other examples, two blade sets may be used or a single blade set with blades in multiple planes may be used such that when a piece of food is sliced into multiple slices, e.g. a bagel sliced into three slices, for example, to provide a "club" portion in addition to the crown and heel. In another example using multiple blade sets, the bagel first comes into contact with only a single blade, which promotes the slicing of the bagel without crushing or deformation of the bagel and once the slicing action with the first blade has started the food comes into contact with the second blade, facilitating cutting by the second blade further without crushing or deformation of the bagel.

In still further examples, the slicer is arranged to divert one or more of the resulting sliced pieces to a desired position or location. An example of this may include diverting the bagel crown from the bagel heel. This may occur when the slicer 10 is in the sliced position or may occur when the slicer is returned to the open position with the sliced bagel. A slicer exemplarily including features as described above may be oriented to slice the bagel, exemplarily by a pulling action, rather than by a pushing action by the user. In such an embodiment, the unsliced bagel product is loaded at a location on the slicer distal from a handle on the moveable cradle while the cradle is pulled toward the user and the sliced bagel is dispensed at a location on the slicer proximal to the user. The sliced bagel may be retrieved from this location by the user or may be diverted to a collection location.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A bagel slicer comprising:

a frame;

a pusher assembly translatable along a slicing path within the frame between an open position and a sliced position;

at least one blade positioned within the slicing path;

a crown caddy having a body and an aperture through the body, the crown caddy connected to the pusher assembly; and a sled connected to the pusher assembly, the sled aligned with and spaced apart from the crown caddy;

wherein the pusher assembly is configured to translate a bagel along the slicing path about the at least one blade to slice the bagel and the pusher assembly is configured to return the sliced bagel to the open position of the pusher assembly.

2. The bagel slicer of claim 1, wherein the sled comprises a depression formed into the body of the sled, the depression of the sled in alignment with the aperture of the crown caddy.

3. The bagel slicer of claim 2, wherein the crown caddy is spaced apart from the sled by a distance to receive the at least one blade therebetween.

4. The bagel slicer of claim 1, further comprising a cover secured across the frame to enclose at least a portion of the bagel slicer.

5. The bagel slicer of claim 4, wherein the cover encloses an area about the crown caddy and the sled when the pusher assembly is in the sliced position.

6. The bagel slicer of claim 1, wherein the pusher assembly further comprises:

a pusher structure comprising a handle at one end and an end plate at an end opposite the handle;

an inside cover secured to the pusher structure and extending over the end plate, wherein the crown caddy engages the end plate and the inside cover; and a heel cover secured to the pusher structure, the heel cover comprising a tie that extends past the at least one blade and comprising a planar portion that extends from the tie at a position that translates with the pusher assembly along a side of the at least one blade opposite from the pusher structure, wherein the sled engages the heel cover.

7. The bagel slicer of claim 1, wherein the at least one blade is a pair of blades angled towards a centerline of the frame and away from the pusher assembly in the open position.

8. The bagel slicer of claim 7, wherein the pair of blades comprise blade arms secured to the frame.

9. The bagel slicer of claim 8, wherein the blade arms are secured on an exterior of the frame and the pair of blades extend through respective slots in the frame to an interior of the frame.

10. A bagel slicer comprising:

a frame having first and second sides extending from a base;

a pusher assembly translatable along a slicing path within the frame between an open position and a sliced position;

a pair of blades positioned within the slicing path, the pair of blades secured to the frame and angled towards a centerline of the frame and away from the pusher assembly in the open position;

a sled connected to the pusher assembly; and a crown caddy having a body and an aperture through the body, the crown caddy connected to the pusher assembly;

wherein the crown caddy is spaced apart from the sled by a distance configured to receive the pair of blades therebetween as the pusher assembly translates along the slicing path between the open position and the sliced position; and wherein the pusher assembly is configured to translate a bagel along the slicing path about the pair of blades to slice the bagel and the pusher assembly is configured to return the sliced bagel to the open position of the pusher assembly.

11. The bagel slicer of claim 10, further comprising a pair of rails that extend internal the frame, wherein the pusher assembly is movably secured to and translates along the pair of rails.

12. The bagel slicer of claim 10 wherein the pusher assembly comprises a pusher structure comprising a handle at one end and a depending plate, a planar plate, and an end plate arranged at an end opposite the handle.

13. The bagel slicer of claim 12, further comprising:

a rail that extends internal the frame;

aligned apertures through the depending plate and the end plate of the pusher structure;

a coaxial spacer extending between the aligned apertures; and wherein the rail extends through the aligned apertures and the coaxial spacer.

14. The bagel slicer of claim 12, further comprising a heel cover secured at a heel cover body to the pusher structure, the heel cover narrowing from the heel cover body to a tie, the tie connected to a planar portion of the heel cover that translates along a side of the pair of blades opposite the heel cover body.

15. The bagel slicer of claim 14, wherein the sled is connected to the pusher assembly at the heel cover.

16. The bagel slicer of claim 12, further comprising an inside cover secured at an inside cover body to the pusher structure, the inside cover extending over the depending plate, the planar plate, and the end plate, the inside cover comprising a cover flange that extends along the end plate of the pusher structure.

17. The bagel slicer of claim 16, wherein the crown caddy is connected to the pusher structure by engagement between the crown caddy and the cover flange and the end plate.

18. A method of slicing a bagel comprising:

providing a slicer of claim 10;

moving the pusher assembly to the open position;

loading an unsliced bagel through the aperture of the crown caddy to rest on the sled;

moving the pusher assembly along the slicing path to the sliced position to move the crown caddy and the sled past the pair of blades on opposite sides of the pair of blades; and slicing the bagel into a crown portion and a heel portion as the pair of blades moves between the crown caddy and the sled.

19. The method of slicing a bagel of claim 18, further comprising:

moving the pusher assembly from the sliced position to the open position along the slicing path;

moving the crown portion of the bagel and the crown caddy along a first side of the pair of blades and moving the heel portion of the bagel and the sled along a second side of the pair of blades; and providing the crown portion and the heel portion of the bagel on the sled with the pusher assembly in the open position.

* * * * *